US011457306B1

(12) United States Patent
Jenson et al.

(10) Patent No.: US 11,457,306 B1
(45) Date of Patent: Sep. 27, 2022

(54) LOUDSPEAKER PORT

(71) Applicant: Robert Bosch GmbH, Stuttgart (DE)

(72) Inventors: Adam Jenson, Woodbury, MN (US); Michael D. Kasten, Burnsville, MN (US)

(73) Assignee: Robert Bosch GMBH, Stuttgart (DE)

( * ) Notice: Subject to any disclaimer, the term of this patent is extended or adjusted under 35 U.S.C. 154(b) by 0 days.

(21) Appl. No.: 17/392,041

(22) Filed: Aug. 2, 2021

(51) Int. Cl.

| | |
|---|---|
| ***H04R 1/34*** | (2006.01) |
| ***H04R 1/02*** | (2006.01) |
| ***H04R 1/32*** | (2006.01) |
| ***H04R 1/30*** | (2006.01) |

(52) U.S. Cl.
CPC ..... *H04R 1/345* (2013.01); *H04R 1/025* (2013.01); *H04R 1/30* (2013.01); *H04R 1/323* (2013.01)

(58) Field of Classification Search
CPC ..... H04R 1/345; H04R 1/025; H04R 1/30; H04R 1/323
USPC ..... 381/345
See application file for complete search history.

(56) References Cited

U.S. PATENT DOCUMENTS

| | | | | |
|---|---|---|---|---|
| 4,314,620 | A | 2/1982 | Gollehon | |
| 4,733,749 | A | 3/1988 | Newman et al. | |
| 4,807,293 | A | 2/1989 | Weckler | |
| 4,860,367 | A * | 8/1989 | Hook | H04R 1/30 181/194 |
| 5,432,860 | A | 7/1995 | Kasajima et al. | |
| 5,533,132 | A | 7/1996 | Button | |
| 6,744,902 | B2 | 6/2004 | Proni | |
| 7,039,212 | B2 | 5/2006 | Polling et al. | |
| 7,590,257 | B1 * | 9/2009 | Blanchard | H04R 1/345 381/342 |
| 7,760,899 | B1 | 7/2010 | Graber | |
| 3,036,410 | A1 | 10/2011 | Koren et al. | |
| 8,094,853 | B2 | 1/2012 | Seki | |
| 8,224,001 | B1 * | 7/2012 | Waller | H04R 1/24 181/150 |
| D695,269 | S | 12/2013 | Carpenter et al. | |

(Continued)

OTHER PUBLICATIONS

Electro-Voice, "ZLX Portable Loudspeakers", <https://products.electrovoice.com/na/en/zlx-portable-loudspeakers>, 2018, 4 pages.

*Primary Examiner* — Sean H Nguyen
(74) *Attorney, Agent, or Firm* — Michael Best & Friedrich LLP

(57) ABSTRACT

A loudspeaker assembly includes an enclosure defining a direction for projecting sound, a first transducer and a second transducer positioned within the enclosure, an acoustic horn coupled with the first transducer, a mounting baffle secured to the enclosure for supporting the second transducer, and a port establishing fluid communication along a port length between the interior of the enclosure and an outside environment in front of the open front side of the enclosure. The acoustic horn has a surface facing an interior of the enclosure. A forward portion of the port is formed by a forward face of the mounting baffle and an extension wall depending from the acoustic horn in a direction transverse to the direction. The port length is extended by a rearward port portion formed by a rearward extending flange of the mounting baffle and a rearward projection extending from the surface of the acoustic horn.

20 Claims, 6 Drawing Sheets

(56) References Cited

U.S. PATENT DOCUMENTS

| | | | | |
|---|---|---|---|---|
| 2006/0029241 | A1* | 2/2006 | Graber | H04R 1/227<br>381/182 |
| 2009/0046875 | A1* | 2/2009 | Masuda | H04R 1/30<br>381/152 |
| 2020/0314546 | A1 | 10/2020 | Aleksandrov | |

* cited by examiner

LOUDSPEAKER PORT

BACKGROUND

The present invention relates to ports for audio speakers. A speaker is an electromechanical device that produces acoustic signals across a frequency range depending, at least in part, on one or more types of drivers used in the speaker.

SUMMARY

The invention provides, in one aspect, a loudspeaker assembly including an enclosure, a first transducer positioned within the enclosure, and a second transducer positioned within the enclosure. The enclosure has an open front side defining a forward direction for projecting sound. The loudspeaker assembly also includes an acoustic horn coupled with the first transducer. The acoustic horn has a front surface configured to direct the sound from the first transducer, and the acoustic horn has a rear surface facing an interior of the enclosure. The loudspeaker assembly also includes a mounting baffle secured to the interior of the enclosure for supporting the second transducer, and a port establishing fluid communication along a port length between the interior of the enclosure and an outside environment in front of the open front side of the enclosure. A forward portion of the port is formed by a forward face of the mounting baffle and an extension wall depending from the acoustic horn in a direction transverse to the forward direction. The port length is extended by a rearward port portion formed by a rearward extending flange of the mounting baffle and a rearward projection extending from the rear surface of the acoustic horn.

The invention provides, in another aspect, a loudspeaker assembly including an enclosure having an open front side defining a forward direction for projecting sound, a first transducer positioned within the enclosure, and an acoustic horn coupled with the first transducer. The acoustic horn has a flared front surface configured to direct the sound from the first transducer, and the acoustic horn has a rear surface facing an interior of the enclosure. The loudspeaker assembly also includes a second transducer positioned within the enclosure. The second transducer is a woofer assembly configured to output sound in a lower frequency register than the first transducer. The loudspeaker assembly also includes a mounting baffle secured to the interior of the enclosure for supporting the second transducer, and a port establishing fluid communication between the interior of the enclosure and an outside environment in front of the open front side of the enclosure. The mounting baffle and the acoustic horn cooperate to form the port. At a forward end of the acoustic horn, an extension wall depends therefrom to turn the port in a direction transverse to the forward direction, the depending extension wall lying directly in front of a peripheral portion of a cone of the woofer assembly. The acoustic horn has four flared sides, one of which is positioned adjacent the second transducer and extends to the depending extension wall as an integral extension thereof. The depending extension wall has a wall thickness greater than a wall thickness of the rearward extension and greater than a wall thickness of the flared side from which the extension wall depends. A front surface of the extension wall depending from the acoustic horn supports an exterior grille against deflection into the interior of the enclosure.

The invention provides, in yet another aspect, a loudspeaker assembly including an enclosure having an open front side defining a forward direction for projecting sound, a first transducer positioned within the enclosure, and an acoustic horn coupled with the first transducer. The acoustic horn has a front surface configured to direct the sound from the first transducer, and the acoustic horn has a rear surface facing an interior of the enclosure. The loudspeaker assembly also includes a second transducer positioned within the enclosure, a mounting baffle secured to the interior of the enclosure for supporting the second transducer, a port establishing fluid communication between the interior of the enclosure and an outside environment in front of the open front side of the enclosure, and a grille at least partially closing the open front side of the enclosure. The acoustic horn has four sides, one of which is positioned adjacent the second transducer and includes an integral forward extension and an integral rearward extension between which a flared portion of the acoustic horn rear surface cooperates to form the port with the mounting baffle. The forward extension has a wall thickness greater than a wall thickness of the rearward extension and greater than a wall thickness of the flared portion of the acoustic horn. The forward extension of the acoustic horn supports the grille against deflection into the interior of the enclosure.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
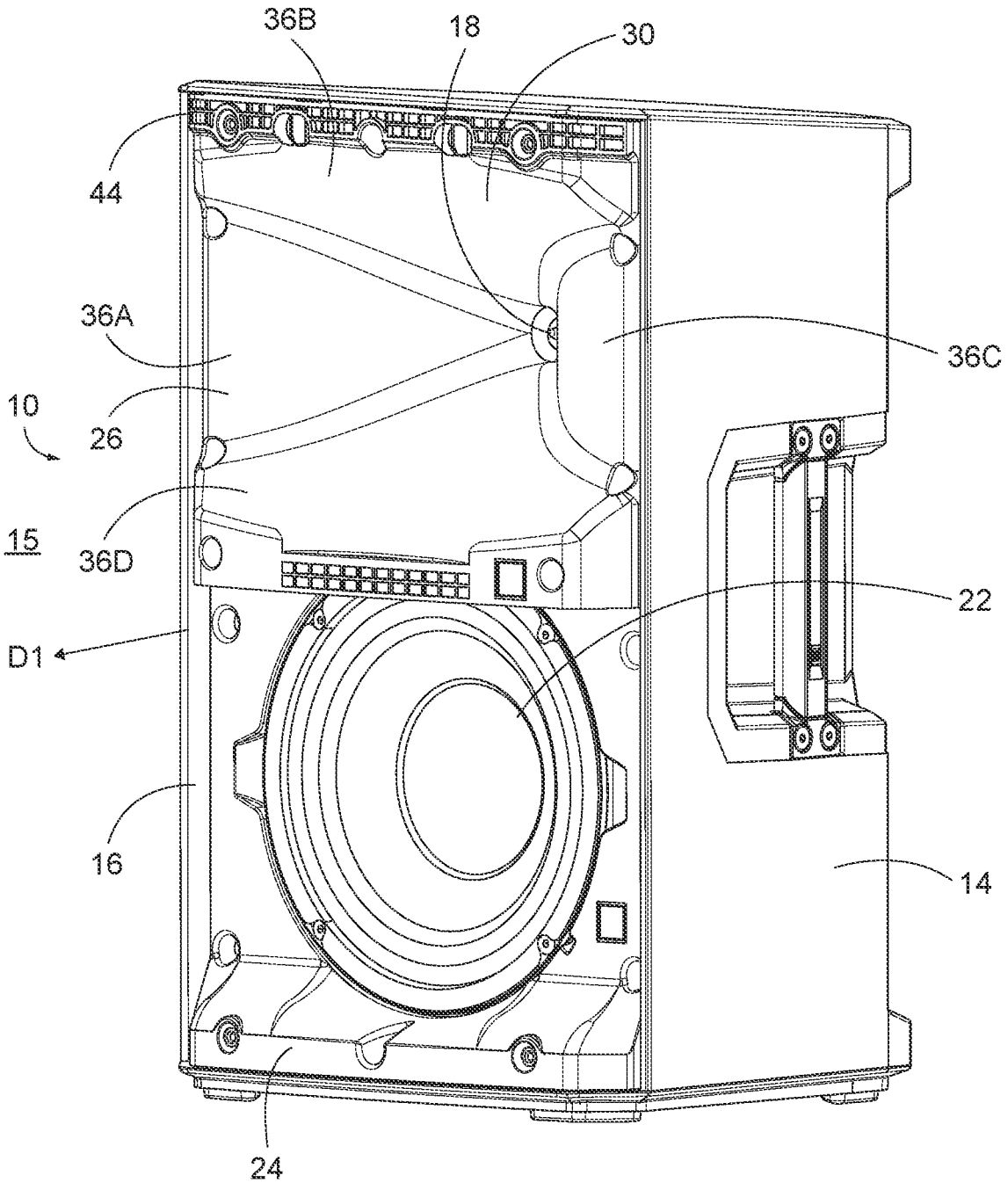
FIG. 1 is a perspective view of a loudspeaker assembly according to an embodiment of the invention.
Figure 2:
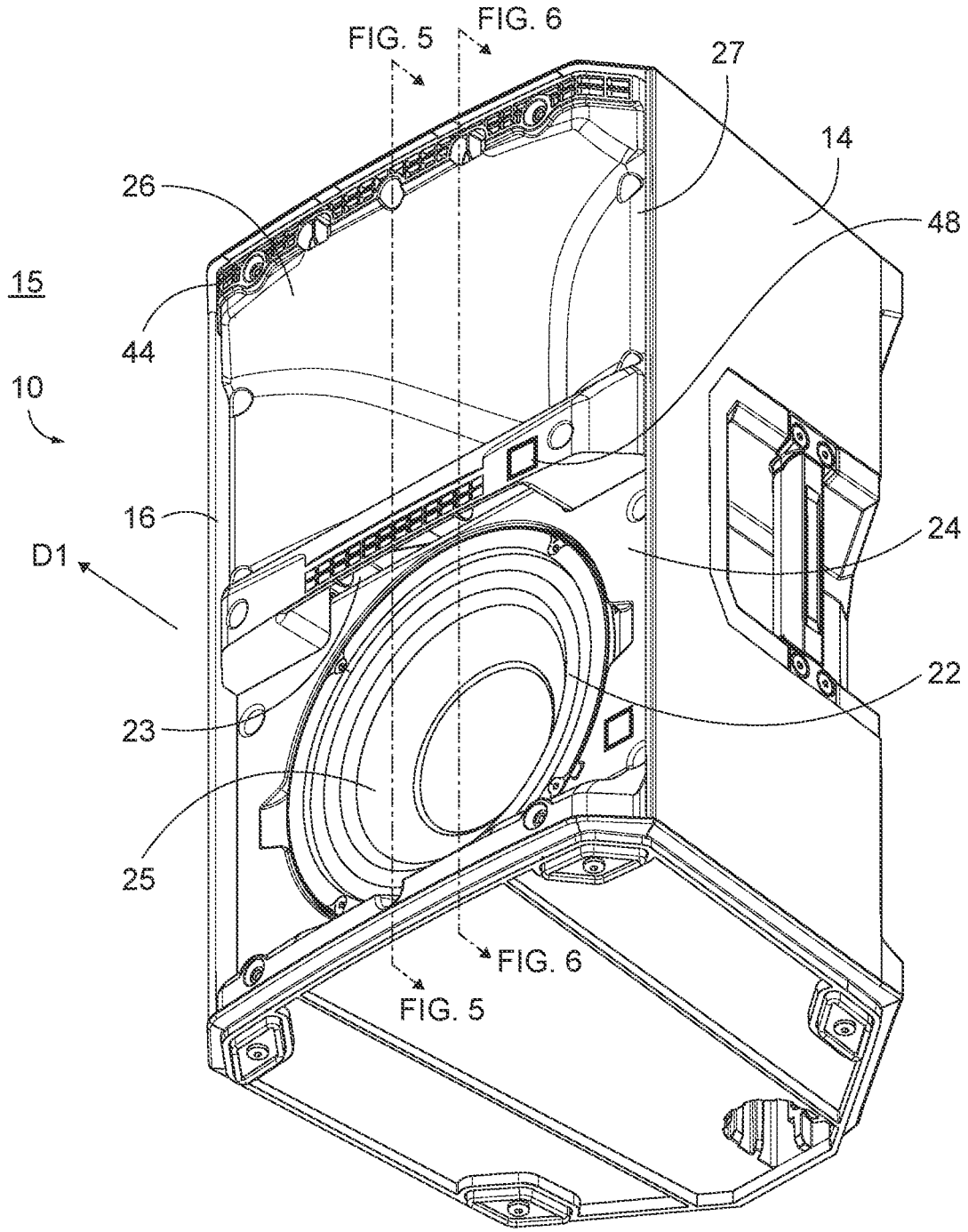
FIG. 2 is a bottom perspective view of the loudspeaker assembly of FIG. 1.
Figure 3:
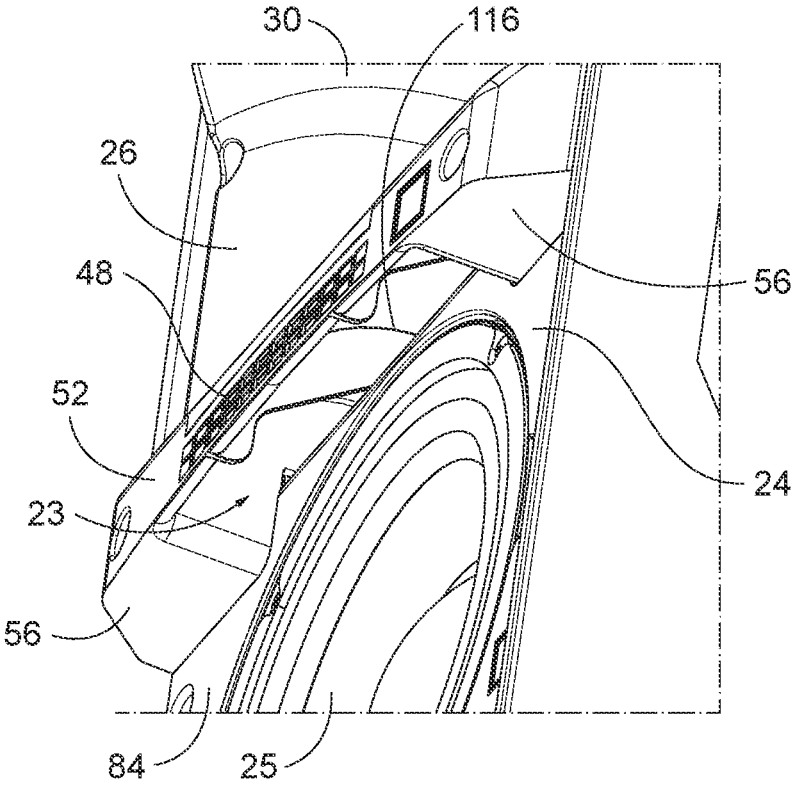
FIG. 3 is an enlarged perspective view of the loudspeaker assembly of FIG. 1.
Figure 4:
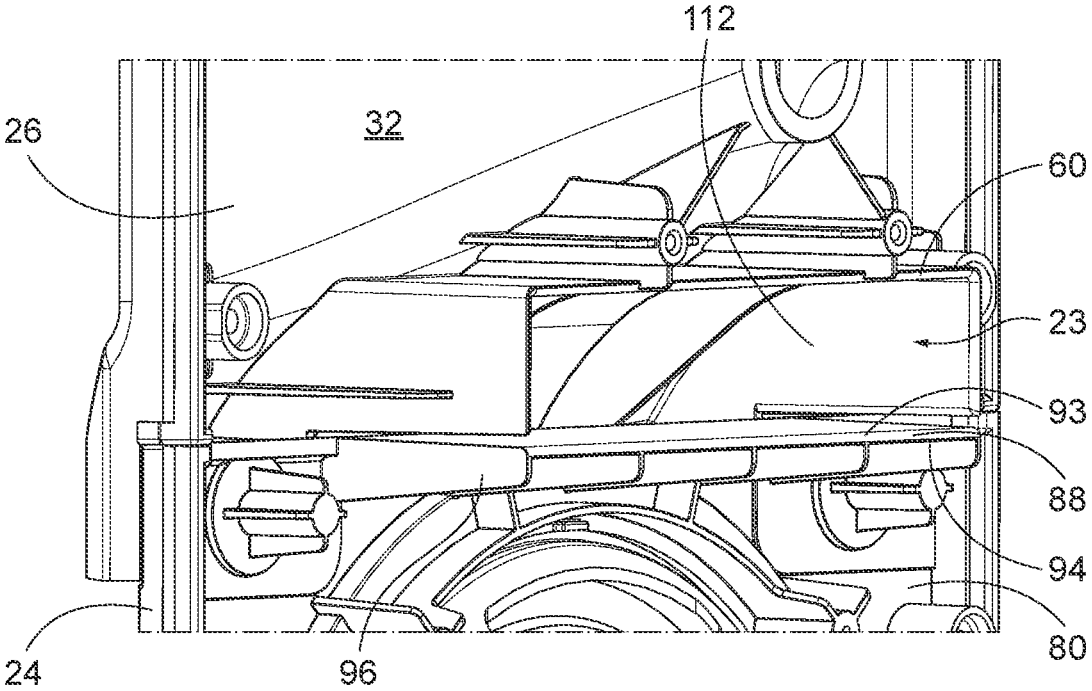
FIG. 4 is an enlarged perspective view of a mounting baffle, a second transducer, and an acoustic horn of the loudspeaker assembly of FIG. 1.
Figure 5:
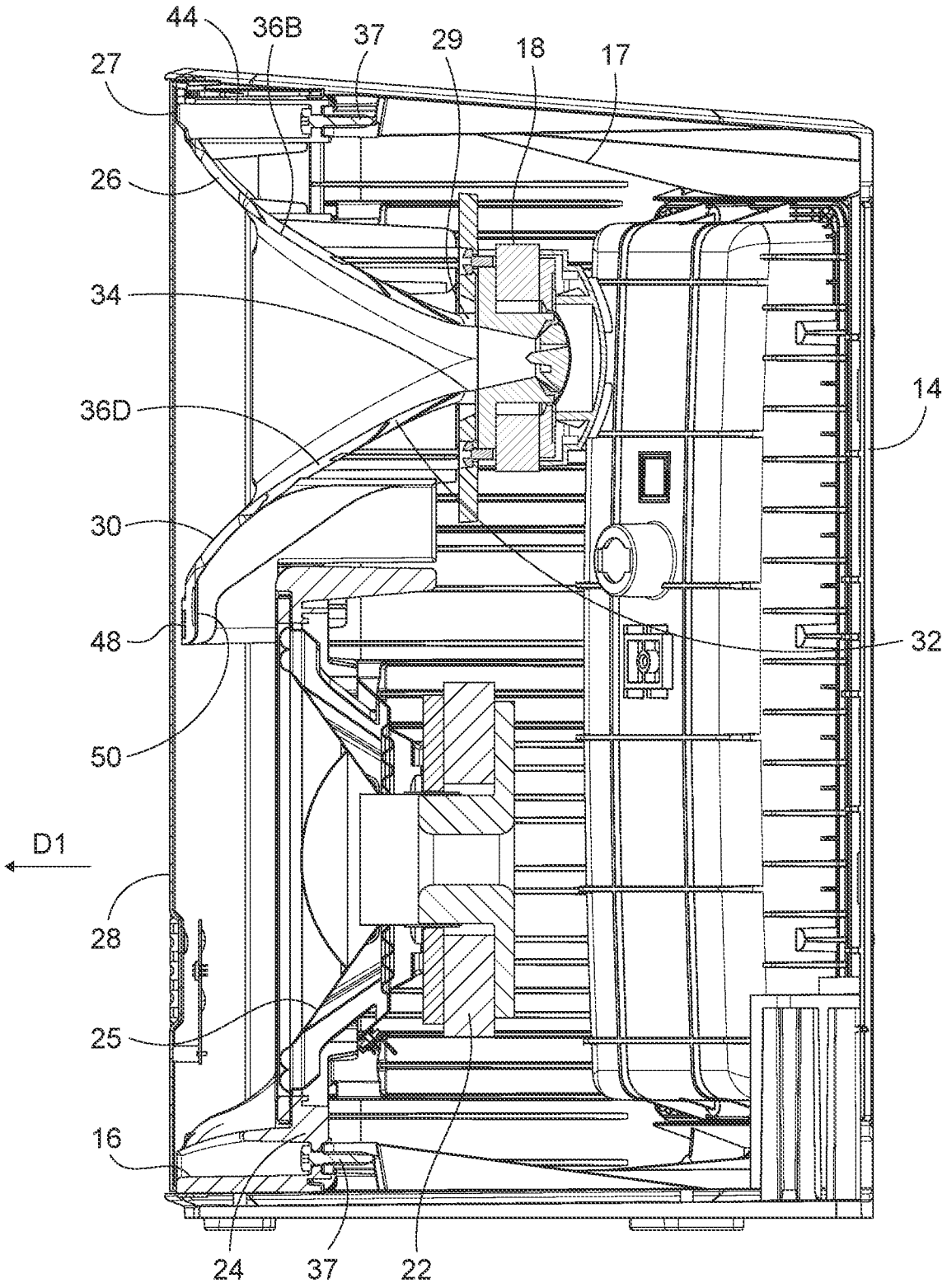
FIG. 5 is a cross-section view along a line 5-5 of the loudspeaker assembly of FIG. 1.

A loudspeaker assembly 10, as shown in FIGS. 1, 2 and 5, includes an enclosure 14. In some scenarios, the loudspeaker assembly 10 can be arranged so that sound may be directed upwards toward a performer. The loudspeaker assembly 10 can alternately be arranged to project or direct sound to an audience. The loudspeaker assembly 10 may be mounted on a post or may be set on a flat surface such as a stage or a floor. The enclosure 14 has an open front side 16 defining a forward direction D1 for projecting sound. The enclosure 14 additionally defines an interior 17 (see FIG. 5). The loudspeaker assembly 10 also includes a first transducer 18 and a second transducer 22 each positioned within the enclosure 14. The loudspeaker assembly 10 additionally includes a mounting baffle 24 supporting the second transducer 22 and an acoustic horn 26 coupled with the first transducer 18. The loudspeaker assembly 10 includes a port 23 establishing fluid communication along a port length L (see FIG. 6) between the interior 17 of the enclosure 14 and an outside environment 15 in front of the open front side 16 of the enclosure 14. The mounting baffle 24 and the acoustic horn 26 cooperate to form the port 23.

The first transducer 18 and the second transducer 22 are capable of reproducing one or more acoustic signals within certain frequency ranges, frequency bands, or bandwidths. The first transducer 18 is a compression driver configured to output sound in a high-frequency register. The second transducer 22 is a woofer assembly configured to output sound in a lower frequency register than the first transducer 18. The second transducer 22 is generally frustoconical in shape. The second transducer 22 includes a cone 25. The cone 25 is configured to direct sound from the second transducer 22. The second transducer 22 is mounted to the enclosure 14 via the mounting baffle 24. In other embodiments, additional or alternative transducers can be included in the loudspeaker assembly 10. An exterior grille 28 at least partially closes the open front side 16 of the enclosure 14, although the grille 28 is sound transmissive so that sound from the transducers 18, 22 is projected through the grille 28. In some embodiments, the grille 28 may completely close the open front side 16 of the enclosure. The grille 28 may be a rigid or flexible grille material and may be positioned over the first transducer 18 and the second transducer 22.

The acoustic horn 26 is configured to direct sound from the first transducer 18. The acoustic horn 26 includes a front end 27 adjacent the front side 16 of the enclosure 14 and a back end 29 adjacent the first transducer 18. The first transducer 18 is secured to the interior of the enclosure 14 by the acoustic horn 26. The acoustic horn 26 is coupled to the enclosure 14 via fasteners. The acoustic horn 26 has a front surface 30 configured to direct sound from the first transducer 18. The front surface 30 is flared. The acoustic horn 26 also has a rear surface 32 facing the interior 17 of the enclosure 14. The rear surface 32 is opposite the front surface 30 and follows the contour set by the front surface 30, except as noted below. In the illustrated embodiment, the acoustic horn 26 has four sides 36A-D. In other embodiments, the acoustic horn 26 may be frustoconical. The four sides 36A-D are all flared out from a rear end opening 34 where sound is introduced to the acoustic horn 26 from the first transducer 18. Specifically, each of the sides 36A-D includes a curved profile that is curved or bowed away from the interior 17 such that the rear surface 32 is concave and the front surface 30 is convex. Each of the sides 36A-D extends from the first transducer 18 to the front side 16 of the enclosure 14.

The acoustic horn 26 further includes an outer frame 44 surrounding the four sides 36A-D. In the illustrated embodiment, the outer frame 44 is integral with the four sides 36A-D. In other embodiments, the outer frame 44 may be separate from the four sides 36A-D. The outer frame 44 is coupled to the enclosure 14 so that the four sides 36A-D are mounted to the enclosure 14. The outer frame 44 is coupled to the enclosure 14 via fasteners 37, e.g., screws (see FIG. 5).

An extension wall 48, formed as an integral forward extension in the illustrated construction, depends from the acoustic horn 26 in a direction transverse to the forward direction D1. Specifically, the extension wall 48 depends from one of the four flared sides 36D that is positioned adjacent the second transducer 22. The one of the four flared sides 36D extends to the depending extension wall 48 as an integral extension thereof. As used herein, integral refers to being made of unitary construction (e.g., molded as a single component) rather than assembled from separate pieces. Although shown as integral, in other embodiments, the extension wall 48 may be a separate component that is fixed to the acoustic horn 26. The extension wall 48 is substantially planar and extends along the enclosure front side 16, e.g., parallel to the mounting baffle 24.

With reference to FIGS. 3-6, the extension wall 48 includes a back surface 50 facing the mounting baffle 24 and a front surface 52 opposite the back surface 50. Mounting blocks 56 (FIGS. 3 and 7) are disposed at each end of the extension wall 48 on the back surface 50. Each of the mounting blocks 56 is integral with the extension wall 48. The mounting blocks 56 are coupled to the mounting baffle 24 via fasteners to support the extension wall 48 on the mounting baffle 24. The front surface 52 of the extension wall 48 provides a rigid backstop for the exterior grille 28. The front surface 52 of the extension wall 48 supports the exterior grille 28 against deflection into the interior 17 of the enclosure 14. For example, the rear side of the grille 28 may abut the front surface 52 or be arranged within close proximity, e.g., within 5 mm or within 10 mm, when the loudspeaker assembly 10 is fully assembled. Vibration of the exterior grille 28 may also be reduced by the extension wall 48.

Figure 6:
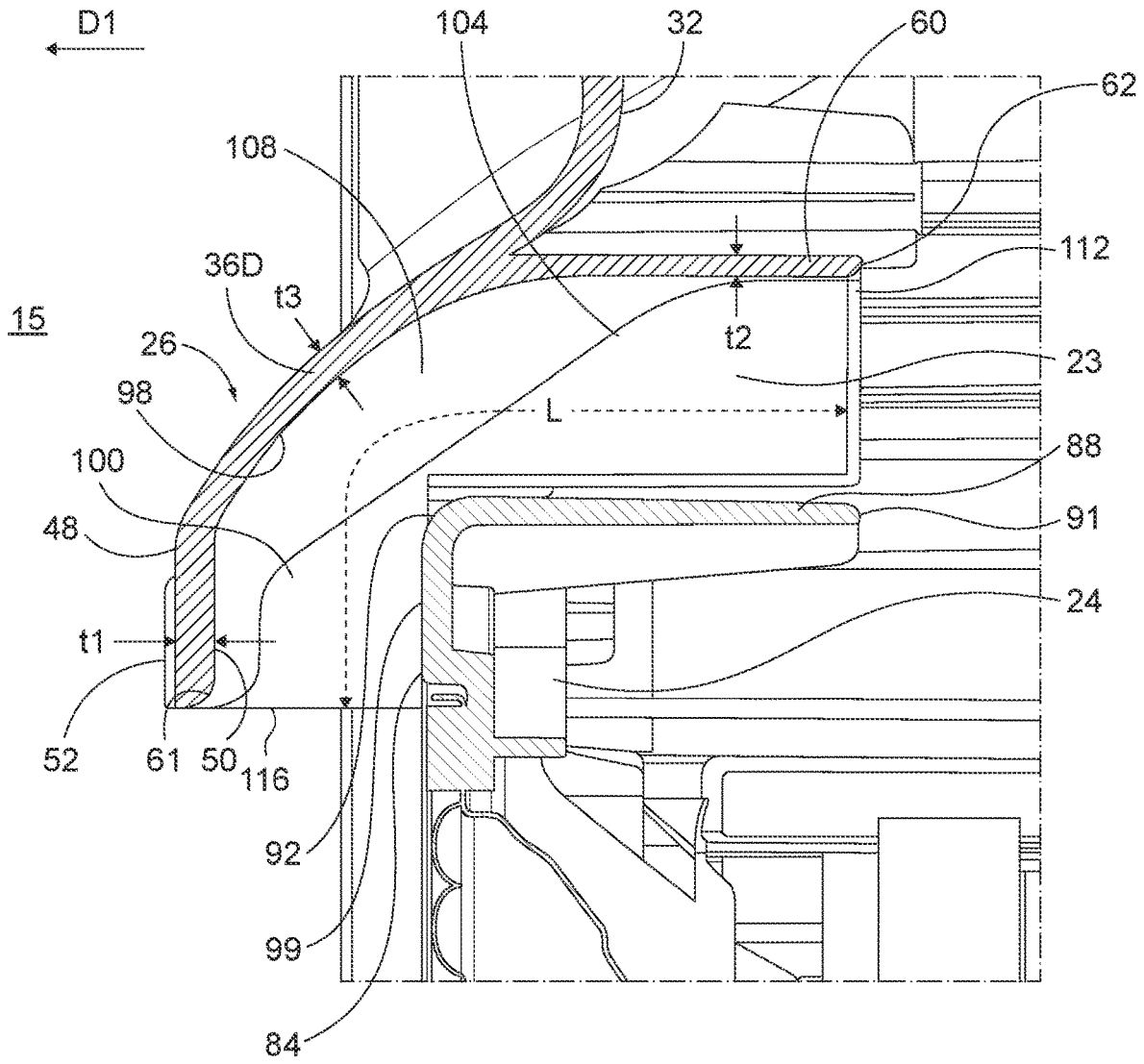
FIG. 6 is an enlarged cross-section view along a line 6-6 of the loudspeaker assembly of FIG. 1.

A rearward extension or projection 60 extends from the rear surface 32 of the acoustic horn 26 as shown in FIG. 6. Specifically, the rearward projection 60 extends from the flared side 36D that is positioned adjacent the second transducer 22. The rearward projection 60 projects from a portion of the acoustic horn 26 that is between the forward end 27 and the back end 29. The rearward projection 60 is substantially planar and extends in a direction that is parallel to, and opposite, the forward direction D1. In the illustrated embodiment, the acoustic horn 26 and the rearward projection 60 are integral (i.e., formed as a single piece). In other embodiments, the rearward projection 60 may be a separate part from the acoustic horn 26 and mounted on the rear surface 32 of the acoustic horn 26. In other embodiments, the rearward projection 60 may be integral with the mounting baffle 24. In other embodiments, the rearward projection 60 may be a separate part mounted on the mounting baffle 24. A continuous surface is formed by the extension wall 48, the rearward projection 60, and a portion of the acoustic horn 26 between the extension wall 48 and the rearward projection 60.

The extension wall 48 includes a fillet 61 at a distal end of the extension wall 48 remote from the portion of the acoustic horn 26. The fillet 61 of the extension wall 48 has a radius which can in some constructions be greater than 1 mm and less than 10 mm, preferably is greater than 3 mm and less than 7 mm, and preferably is 5 mm. The rearward projection 60 includes a fillet 62 at a distal end of the rearward projection 60 remote from the portion of the acoustic horn 26. The fillet 62 of the rearward projection 60 has a radius which can in some constructions be greater than 1 mm and less than 3 mm, preferably is greater than 1.5 mm and less than 2 mm, and preferably is 1.75 mm. In the illustrated embodiment, the extension wall 48 has a wall thickness t1 that is greater than a wall thickness t2 of the rearward projection 60. The wall thickness t1 of the extension wall 48 is greater than a wall thickness t3 of the flared side 36D from which the extension wall 48 depends between the extension wall 48 and the rearward projection 60. The wall thickness t2 of the rearward projection 60 is less than the wall thickness t3 of the flared side 36D. In other embodiments, the wall thicknesses t1, t2, t3 are equal to each other.

Figure 7:
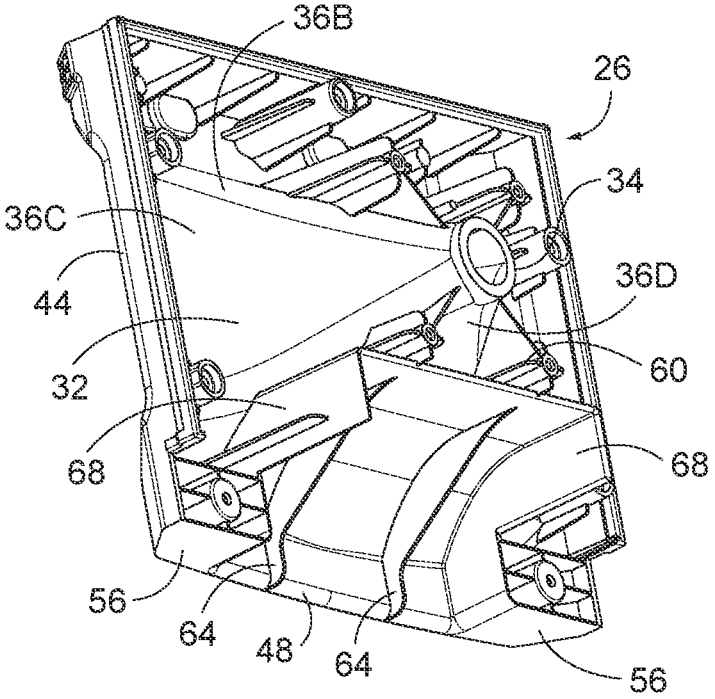
FIG. 7 is a perspective view of the acoustic horn of the loudspeaker assembly of FIG. 1.

With reference to FIG. 7, the acoustic horn 26 further includes a plurality of ribs 64 supporting the rearward projection 60 and the extension wall 48. In the illustrated embodiment, the acoustic horn 26 includes two ribs 64. A contour of the ribs 64 is defined by the continuous surface formed by the extension wall 48, the portion of the acoustic horn 26, and the rearward projection 60. The ribs 64 project from and perpendicular to the continuous surface formed by the extension wall 48, the portion of the acoustic horn 26, and the rearward projection 60. The ribs 64 reinforce the extension wall 48, the portion of the acoustic horn 26, and the rearward projection 60 so that the extension wall 48 and the rearward projection 60 do not deflect towards each other. The acoustic horn 26 includes a side wall 68 on each side of the extension wall 48 and the rearward projection 60. In the illustrated embodiment, the side walls 68 are integral with the acoustic horn 26. In other embodiments, the side walls 68 can be separate components that are mounted to either the acoustic horn 26 or the mounting baffle 24. In other embodiments, the side walls 68 can be integral with the mounting baffle 24. A contour of the side walls 68 is defined by the continuous surface formed by the extension wall 48, a portion of the acoustic horn 26, and the rearward projection 60. Each of the side walls 68 extends from a corresponding one of the mounting blocks 56.

Figure 8:
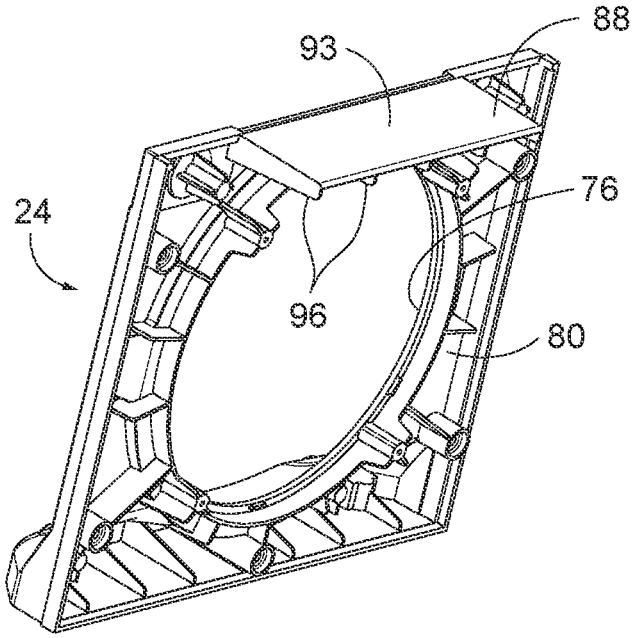
FIG. 8 a perspective view of the mounting baffle of the loudspeaker assembly of FIG. 1.

With reference back to FIGS. 5, 6 and 8 the second transducer 22 is mounted to the enclosure 14 via the mounting baffle 24. The mounting baffle 24 includes an opening 76 configured to receive the second transducer 22. The opening 76 can be circular in shape, and may be placed in the center of the mounting baffle 24. The mounting baffle 24 is secured to the interior 17 of the enclosure 14 via fasteners 37, e.g., screws. The acoustic horn 26 and the mounting baffle 24 are positioned directly adjacent each other. The extension wall 48 lies directly in front of a portion of the mounting baffle 24. In some embodiments, the extension wall 48 may lie directly in front a peripheral portion of the cone 25 of the second transducer 22. The mounting baffle 24 defines a rearward face 80 facing the interior 17 of the enclosure 14 and a forward face 84 opposite the rearward face 80. The forward face 84 faces an outside environment 15 outside of the enclosure 14.

The mounting baffle 24 further includes a rearward extending flange 88. The rearward extending flange 88 is substantially planar and extends perpendicular to the forward face 84 of the mounting baffle 24. The rearward extending flange 88 extends from the forward face 84 towards the interior 17 of the enclosure 14. A fillet 91 is formed at a distal end of the rearward extending flange 88 remote from the junction of the forward face 84 and the rearward extending flange 88. The fillet 91 of the rearward extending flange 88 curves away from the port 23. The fillet 91 of the rearward extending flange 88 has a radius which can in some constructions be greater than 0.5 mm and less than 5 mm, preferably is greater than 1 mm and less than 3 mm, and preferably is 2 mm. A fillet 92 is formed at the junction of the forward face 84 and the rearward extending flange 88. The rearward extending flange 88 extends parallel to the forward direction D1. In some embodiments, the fillet 92 of the has a radius which is greater than 5 mm and less than 10 mm, preferably is 8 mm.

The rearward projection 60 of the acoustic horn 26 and the rearward extending flange 88 of the mounting baffle 24 are parallel. In the illustrated embodiment, the mounting baffle 24 is one-piece including the rearward extending flange 88. In other embodiments, the rearward extending flange 88 may be a separate piece that is mounted to the mounting baffle 24. In other embodiments, the rearward extending flange 88 may be a separate piece mounted to the acoustic horn 26. In other embodiments, the rearward extending flange 88 may be integral with the acoustic horn 26. In other embodiments, the rearward extending flange 88, the rearward projection 60 and the side walls 68 are integrally formed as one-piece that is mounted to the mounting baffle 24 or the acoustic horn 26 as a separate piece.

The rearward extending flange 88 includes a top surface 93 facing the rearward projection 60 of the acoustic horn 26 and a bottom surface 94 opposite the top surface 93. The mounting baffle 24 includes a plurality of ribs 96 along the bottom surface 94 of the rearward extending flange 88. The plurality of ribs 96 reinforce the rearward extending flange 88 so that the rearward extending flange 88 does not deflect away from or towards the acoustic horn 26. The plurality of ribs 96 are spaced along the width of the rearward extending flange 88.

With reference to FIG. 6, the port 23 is configured to establish a pathway to allow air to pass in and out of the enclosure 14, thus allowing the enclosure's interior volume to be used as a Helmholtz resonance chamber that can be tuned to enhance low-frequency response and an overall output of the speaker assembly 10, particularly the woofer assembly 22. The extension wall 48 and the rearward projection 60 cooperate with the flared portion of the acoustic horn 26 to form the port 23 with the mounting baffle 24. The continuous surface of the acoustic horn 26 formed by the extension wall 48, the portion of the acoustic horn 26, and the rearward projection 60 defines an upper surface 98 of the port 23. A continuous surface of the mounting baffle 24 formed by the rearward extending flange 88, the fillet 92, and a portion of the forward face 84 defines a lower surface 99 of the port 23. The upper surface 98 of the port 23 extends between the two side walls 68 of the acoustic horn 26 and the two mounting blocks 56 of the acoustic horn 26 so that the side walls 68 and the mounting blocks 56 define opposite sides of the port 23.

The port 23 includes a forward port portion 100 and a rearward port portion 104 fluidly connected to the forward port portion 100. The extension wall 48 partially defines the forward port portion 100. The rearward projection 60 partially defines the rearward port portion 104. The port length L is extended by the rearward port portion 104. The forward port portion 100 is substantially perpendicular to the rearward port portion 104. The forward port portion 100 is formed by the forward face 84 of the mounting baffle 24 and the back surface 50 of the extension wall 48. The forward port portion 100 extends out of the interior 17 of the enclosure 14. In some embodiments, the forward port portion 100 may overlap the peripheral portion of the cone 25 of the woofer assembly 22. The rearward port portion 104 is defined by the rearward extending flange 88 of the mounting baffle 24 and the rearward projection 60 of the acoustic horn 26. The rearward port portion 104 is disposed entirely in the interior 17 of the enclosure 14.

The port 23 includes an elbow 108 formed at a junction between the forward port portion 100 and the rearward port portion 104. The elbow 108 has an inner radius formed by the mounting baffle 24 and an outer radius formed by the rear surface of the acoustic horn 26. The inner radius is also defined by the fillet 92 of the mounting baffle 24. The outer radius of the elbow 108 is defined by the flared shape of the acoustic horn 26.

An interior opening 112 or end of the port 23 is disposed in the interior 17 of the enclosure 14. The interior opening 112 is formed at an end of the rearward port portion 104 remote from the elbow 108. A cross-section of the interior opening 112 that is perpendicular to the forward direction D1 is substantially rectangular. The interior opening 112 is defined by the side walls 68 of the acoustic horn 26, the rearward projection 60 and the rearward extending flange 88. The fillet 91 of the rearward extending flange 88 and the fillet 62 of the rearward projection 60 are disposed at the interior opening 112.

An exterior opening 116 or end of the port 23 is at least partially disposed in the outside environment 15 in front of the open front side 16 of the enclosure 14. The exterior opening 116 is fluidly connected to the outside environment 15. The exterior opening 116 is formed at an end of the forward port portion 100 remote from the elbow 108. The exterior opening 116 has a substantially rectangular cross-section that is parallel to the rearward extending flange 88. The exterior opening 116 is defined by the mounting blocks 56 of the acoustic horn 26, the forward face 84 of the mounting baffle 24 and the extension wall 48 of the acoustic horn 26. The fillet 61 of the extension wall 48 is disposed at the exterior opening 116. The cross-section of the interior opening 112 is substantially perpendicular to the cross-section of the exterior opening 116. The air in the enclosure 14 may enter the port 23 through the interior opening 112, pass through the port 23 through the rearward port portion 104, the elbow 108 and the forward port portion 100, and exit the port 23 through the exterior opening 116.

Although the invention has been described in detail with reference to certain preferred embodiments, variations and modifications exist within the scope and spirit of one or more independent aspects of the invention as described.

What is claimed is:

1. A loudspeaker assembly comprising:

an enclosure having an open front side defining a forward direction for projecting sound;

a first transducer positioned within the enclosure;

an acoustic horn coupled with the first transducer, the acoustic horn having a front surface configured to direct the sound from the first transducer, and the acoustic horn having a rear surface facing an interior of the enclosure;

a second transducer positioned within the enclosure;

a mounting baffle secured to the interior of the enclosure for supporting the second transducer; and a port establishing fluid communication along a port length between the interior of the enclosure and an outside environment in front of the open front side of the enclosure, wherein a forward portion of the port is formed by a forward face of the mounting baffle and an extension wall depending from the acoustic horn in a direction transverse to the forward direction, and wherein the port length is extended by a rearward port portion formed by a rearward extending flange of the mounting baffle and a rearward projection extending from the rear surface of the acoustic horn.

2. The loudspeaker assembly of claim 1, wherein the second transducer is a woofer assembly configured to output sound in a lower frequency register than the first transducer.

3. The loudspeaker assembly of claim 2, wherein the acoustic horn has four flared sides, one of which is positioned adjacent the second transducer and extends to the depending extension wall as an integral extension thereof, and wherein a front surface of the extension wall depending from the acoustic horn supports an exterior grille against deflection into the interior of the enclosure.

4. The loudspeaker assembly of claim 2, wherein the depending extension wall lies directly in front of a peripheral portion of a cone of the woofer assembly.

5. The loudspeaker assembly of claim 1, wherein the port includes an elbow formed at a junction of the forward and rearward port portions, the elbow having an inner radius formed by the mounting baffle and an outer radius formed by the rear surface of the acoustic horn.

6. The loudspeaker assembly of claim 1, wherein the acoustic horn includes a forward end adjacent the front side of the enclosure and a back end adjacent the first transducer, and wherein the rearward projection projects from a portion of the acoustic horn between the forward end and the back end.

7. The loudspeaker assembly of claim 1, wherein the depending extension wall is integral with the acoustic horn.

8. The loudspeaker assembly of claim 1, wherein the rearward port portion and the rearward projection both extend in a direction that is parallel to the forward direction.

9. A loudspeaker assembly comprising:

an enclosure having an open front side defining a forward direction for projecting sound;

a first transducer positioned within the enclosure;

an acoustic horn coupled with the first transducer, the acoustic horn having a flared front surface configured to direct the sound from the first transducer, and the acoustic horn having a rear surface facing an interior of the enclosure;

a second transducer positioned within the enclosure, wherein the second transducer is a woofer assembly configured to output sound in a lower frequency register than the first transducer;

a mounting baffle secured to the interior of the enclosure for supporting the second transducer; and a port establishing fluid communication between the interior of the enclosure and an outside environment in front of the open front side of the enclosure, wherein the mounting baffle and the acoustic horn cooperate to form the port, wherein, at a forward end of the acoustic horn, an extension wall depends therefrom to turn the port in a direction transverse to the forward direction, the depending extension wall lying directly in front of a peripheral portion of a cone of the woofer assembly, wherein the acoustic horn has four flared sides, one of which is positioned adjacent the second transducer and extends to the depending extension wall as an integral extension thereof, and wherein a front surface of the extension wall depending from the acoustic horn supports an exterior grille against deflection into the interior of the enclosure.

10. The loudspeaker assembly of claim 9, wherein a first port portion of the port is formed by a forward face of the mounting baffle and the extension wall, wherein a second port portion of the port is formed by a rearward port portion formed by a rearward extending flange of the mounting baffle and a rearward projection extending from the rear surface of the acoustic horn, and wherein the port includes an elbow formed at a junction of the first and second port portions, the elbow having an inner radius formed by the mounting baffle and an outer radius formed by the rear surface of the acoustic horn.

11. The loudspeaker assembly of claim 10, wherein the rearward extending flange and the rearward projection both extend in a direction that is parallel to the forward direction.

12. The loudspeaker assembly of claim 10, wherein the depending extension wall is integral with the acoustic horn.

13. The loudspeaker assembly of claim 9, wherein each of the depending extension wall, the rearward extending flange, and the rearward projection includes a substantially planar surface that defines the port.

14. The loudspeaker assembly of claim 9, wherein the depending extension wall is substantially planar.

15. The loudspeaker assembly of claim 9, wherein the acoustic horn includes a forward end adjacent the depending extension wall and a back end adjacent the first transducer, wherein a rearward projection projects from a portion of the one of the flared sides between the forward end and the back end, and wherein the rearward projection extends a length of the port.

16. A loudspeaker assembly comprising:

an enclosure having an open front side defining a forward direction for projecting sound;

a first transducer positioned within the enclosure;

an acoustic horn coupled with the first transducer, the acoustic horn having a front surface configured to direct the sound from the first transducer, and the acoustic horn having a rear surface facing an interior of the enclosure;

a second transducer positioned within the enclosure;

a mounting baffle secured to the interior of the enclosure for supporting the second transducer;

a port establishing fluid communication between the interior of the enclosure and an outside environment in front of the open front side of the enclosure; and a grille at least partially closing the open front side of the enclosure, wherein the acoustic horn has four sides, one of which is positioned adjacent the second transducer and includes an integral forward extension and an integral rearward extension between which a flared portion of the acoustic horn rear surface cooperates to form the port with the mounting baffle, wherein the forward extension has a wall thickness greater than a wall thickness of the rearward extension and greater than a wall thickness of the flared portion of the acoustic horn, and wherein the forward extension of the acoustic horn supports the grille against deflection into the interior of the enclosure.

17. The loudspeaker assembly of claim 16, wherein the second transducer is a woofer assembly configured to output sound in a lower frequency register than the first transducer.

18. The loudspeaker assembly of claim 16, wherein the forward extension lies directly in front of a peripheral portion of a cone of the second transducer.

19. The loudspeaker assembly of claim 16, wherein the forward extension partially defines a forward port portion of the port the and rearward extension partially defines a rearward port portion, and wherein the port includes an elbow formed at a junction of the forward and rearward port portions, the elbow having an inner radius formed by the mounting baffle and an outer radius formed by the flared portion of the acoustic horn.

20. The loudspeaker assembly of claim 19, wherein the forward extension is substantially planar.

* * * * *